United States Patent [19]

Ishibashi

[11] Patent Number: 5,014,654

[45] Date of Patent: May 14, 1991

[54] INTAKE MANIFOLD FOR INTERNAL COMBUSTION ENGINE

[75] Inventor: Fumikazu Ishibashi, Yamato, Japan

[73] Assignee: Nissan Motor Company, Ltd. of No. 2, Yokohama, Japan

[21] Appl. No.: 476,929

[22] Filed: Feb. 8, 1990

[30] Foreign Application Priority Data

Feb. 14, 1989 [JP] Japan ..... 1-15875

[51] Int. Cl.[5] ..... F02M 35/10

[52] U.S. Cl. ..... 123/52 MC; 123/568

[58] Field of Search ..... 123/52 M, 52 MC, 52 MF, 123/52 MB, 572, 568

[56] References Cited

U.S. PATENT DOCUMENTS

| | | | |
|---|---|---|---|
| 4,262,639 | 4/1981 | Motosugi et al. | 123/52 MB |
| 4,441,464 | 4/1984 | Toyoda et al. | 123/52 MB |
| 4,615,324 | 10/1986 | Choushi et al. | 123/52 MV |
| 4,660,530 | 4/1987 | Sugiyama et al. | 123/52 MB |
| 4,693,226 | 9/1987 | Choma | 123/568 |
| 4,715,329 | 12/1987 | Yasuda et al. | 123/52 MV |
| 4,811,697 | 3/1989 | Kurahashi | 123/572 |
| 4,867,109 | 9/1989 | Tezuka et al. | 123/52 MB |

FOREIGN PATENT DOCUMENTS

| | | | |
|---|---|---|---|
| 0155220 | 9/1983 | Japan | 123/52 MB |
| 0285255 | 11/1988 | Japan | 123/52 M |
| 2027796 | 2/1980 | United Kingdom . | |
| 2195394 | 4/1988 | United Kingdom . | |
| 2203487 | 10/1988 | United Kingdom . | |

*Primary Examiner*—David A. Okonsky

*Attorney, Agent, or Firm*—Pennie & Edmonds

[57] ABSTRACT

An intake manifold for a multi-cylinder internal combustion engine of the type wherein blow-by gas and/or EGR gas is supplied to engine cylinders. The intake manifold comprises a plurality of branch runners each of which has a flange section fixedly secured to a cylinder head of the engine. A rib section integrally bridges the flange sections of the adjacent branch runners and is formed therein with a gas passage through which blow-by gas or EGR gas flows. The gas passage is communicated with the intake air passages of the adjacent branch runners so that the blow-by gas or EGR gas is uniformly distributed into the adjacent branch runners.

14 Claims, 4 Drawing Sheets

INTAKE MANIFOLD FOR INTERNAL COMBUSTION ENGINE

BACKGROUND OF THE INVENTION

1. Field of the Invention

This invention relates to improvements in an intake manifold for a multi-cylinder internal combustion engine, and more particularly to an arrangement of the intake manifold having a gas passage through which additional gas such as blow-by gas or EGR (Exhaust Gas Recirculation) gas is introduced into an intake system of the engine.

2. Description of the Prior Art

In general, an internal combustion engine is provided with an intake manifold which is connected to an intake air collector or to the downstream side of a carburetor and has branch runners corresponding to engine cylinders. Intake air is distributed through the intake manifold into the respective engine cylinders.

Blow-by gas or EGR gas for exhaust gas emission control is required to be mixed with the intake air to be supplied to the respective engine cylinders. For this purpose, usually an outer gallery formed of a metal pipe is provided separate from and along the length of a cylinder head. A plurality of branch pipes are branched off from the outer gallery so that the blow-by gas or the EGR gas is introduced into the upstream sides of the intake ports of the respective engine cylinders. This is disclosed for example in Japanese Utility Model Publication No. 55-40365. Otherwise, there is a case in which the blow-by gas or the EGR gas is introduced directly to the intake air collector and distributed through the intake manifold into the respective engine cylinders.

However, in the former case in which the blow-by gas or the like is distributed through the outer gallery, the number of parts around the intake manifold increases thereby raising the production cost of the engine while complicating the layout of parts around the cylinder head. In addition, since the branch pipes for the respective engine cylinders extend from the outer gallery formed of one pipe, distribution of the gas into the respective engine cylinders tend to become not uniform according to engine operating conditions.

In the latter case in which the gas is introduced directly to the intake air collector, the location to which the gas is introduced is near the throttle valve and therefore there arises a problem that the throttle valve tends to be contaminated with contaminant in the gas under backward flow of the intake air to the carburetor. Additionally, if the intake air collector is located below the outlets of the intake manifold, condensed water from the EGR gas or the like is unavoidably gathered in the intake air collector. Thus, such a type of gas distribution arrangement is not practical.

SUMMARY OF THE INVENTION

It is an object of the present invention to provide an improved intake manifold in which additional gas such as blow-by gas or EGR gas is uniformly supplied to the respective engine cylinders without increasing the number of parts and without complicating the layout of the parts around the cylinder head.

Another object of the present invention is to provide an improved intake manifold in which the additional gas is directly introduced into the respective branch runners at locations near the intake ports of the cylinder head without using an outer gallery.

An intake manifold according to the present invention is for an internal combustion engine. The intake manifold comprises a plurality of branch runners each of which is formed therein with an intake air passage. Each branch runner has a flange section which is fixedly secured to a cylinder head of the engine. A rib section is provided to fixedly connecting the flange sections of the branch runners which are located adjacent with each other. A gas passage is formed in the rib section and communicates with the intake passages of the adjacent branch runners. Additionally, a gas inlet opening is formed in each rib section and communicates with the gas passage in the rib section so that gas is introduced into the gas passage through the gas inlet opening.

Accordingly, the gas such as blow-by gas or EGR gas is introduced through the gas inlet opening into the gas passage formed in the rib section and thereafter uniformly distributed into the left and right side branch runners. Thus, the gas can be uniformly supplied to all engine cylinders. In addition, since such gas introduction is carried out at the locations very near the intake ports of the cylinder head, effective supply of the blow-by gas or EGR gas into the engine cylinders is ensured preventing a throttle valve from contamination due to backward flow of the gas and preventing condensed water from staying in the intake system. Furthermore, the above intake manifold arrangement of the present invention requires few outer pipings thereby facilitating the production thereof while lowering the production cost thereof.

BRIEF DESCRIPTION OF THE DRAWINGS

In the drawings, the same reference numerals designate the same elements and parts throughout all figures, in which.

DETAILED DESCRIPTION OF THE INVENTION

Figure 1:
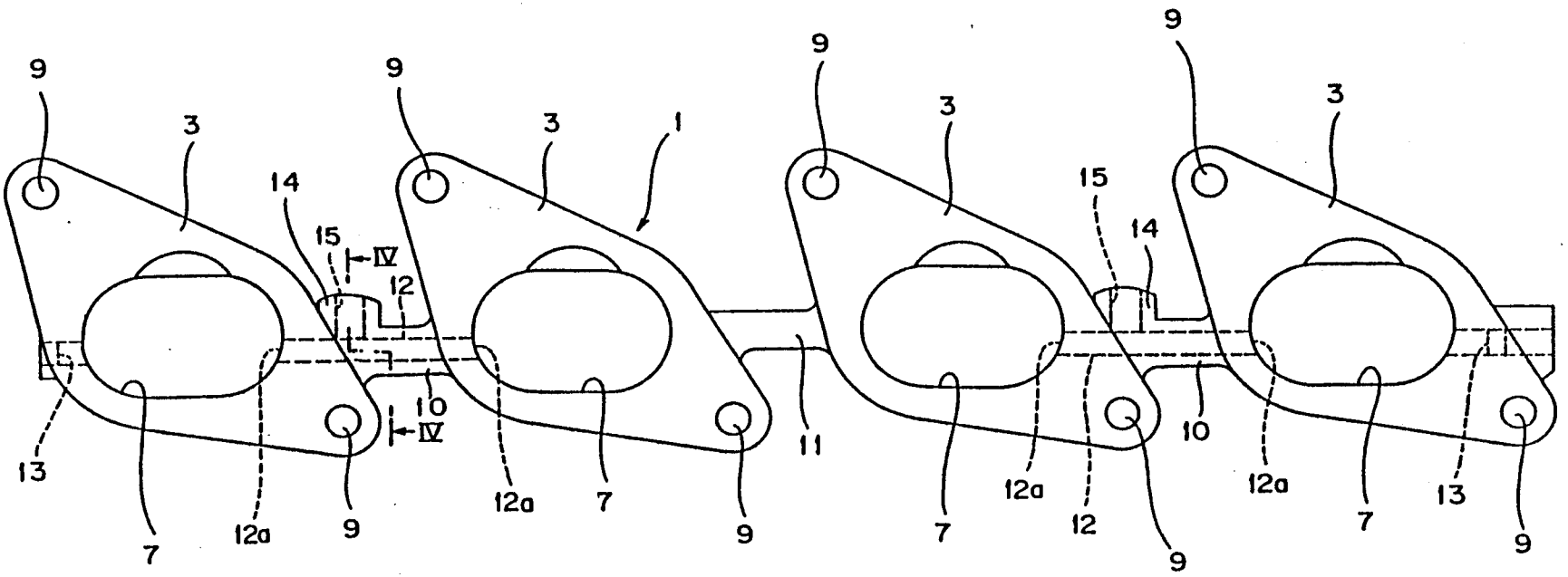
FIG. 1 is a front view of an essential part (including cylinder head side flange sections) of an intake manifold according to the present invention.
Figure 4:
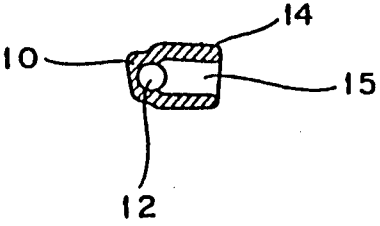
FIG. 4 is a cross-sectional view taken in the direction of arrows substantially along the line IV—IV of FIG. 1.

Referring now to FIGS. 1 to 5, there is shown a preferred embodiment of an intake manifold 1 for an internal combustion engine, in accordance with the present invention. The engine in this embodiment is of the inline four cylinder type. Accordingly, the intake manifold 1 has four branch runners 2 each of which is formed at one end with a flange section 3 which is fixedly secured to the side surface of a cylindedr head (not shown) of the engine. Each branch runner 2 is formed thereinside with an intake air passage (no numeral) through which intake air flows. The intake air passages of the branch runners 2 are respectively communicable with the engine cylinders (not shown) of the engine. A common elongate flange section 5 is provided in such a manner that the respective branch runners 2 are integral at the other ends thereof with the flange section 5. In other words, the other ends of the respective four branch runners 2 are integrally connected with the common flange section 5. The flange section 5 is fixedly connected with an intake air collector 4 through which intake air is distributed into the respective intake air passages 7 of the branch runners 2, as best seen from FIG. 2.

Figure 2:
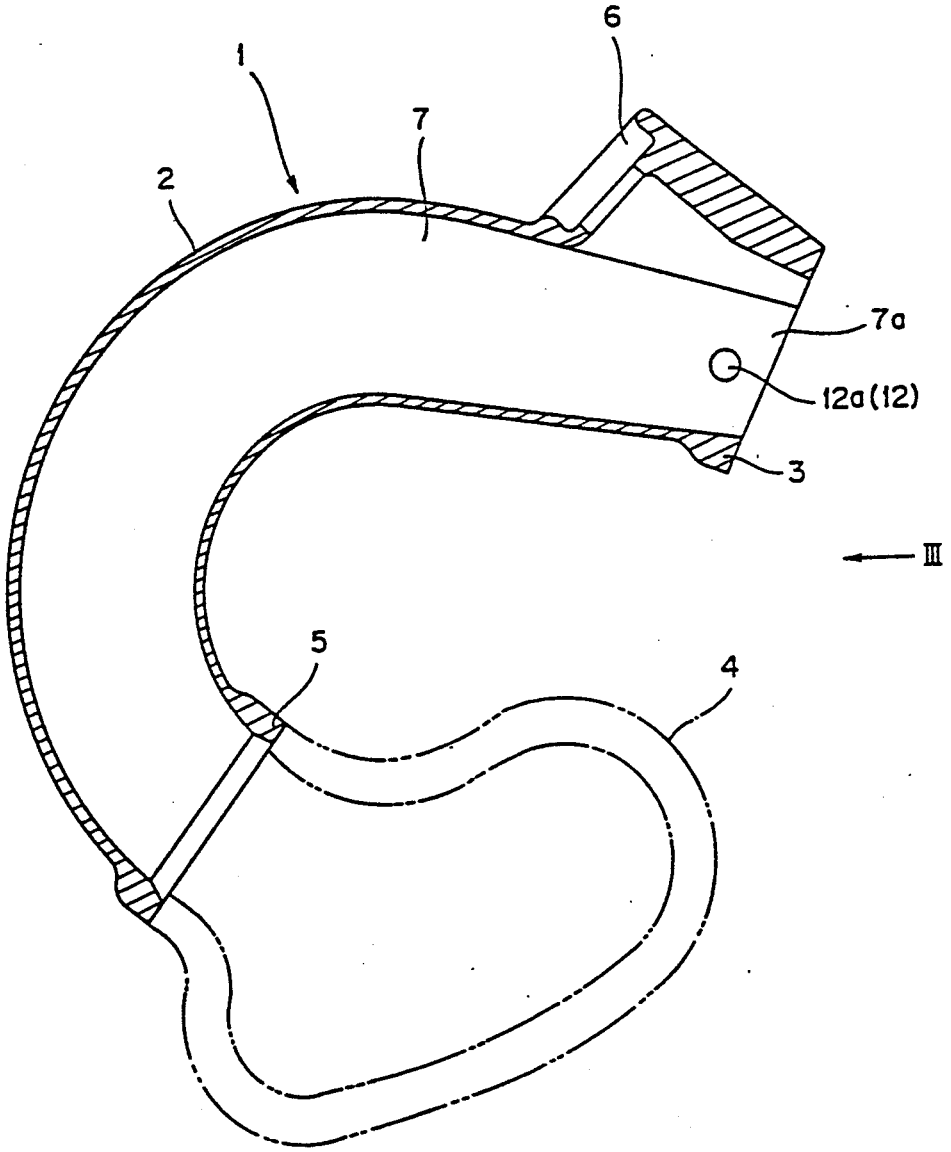
FIG. 2 is a cross-sectional view of the intake manifold of FIG. 1, taken along the axis of a branch runner of the intake manifold.

As shown in FIG. 2, each branch runner 2 is curved generally U-shaped, so that the intake air collector 4 connected with the flange section 5 is located below the cylinder head to which the flange 3 is connected. Each branch runner 2 is formed near the flange 3 with an injector valve installation seat 6 to which a fuel injector valve (not shown) is to be fixedly secured in a manner to be directed to the intake port of the cylinder head so that fuel is injected toward the intake port. In this embodiment, the intake air passage 7 of each branch runner 2 has a right circular cross-section at the side of the intake air collector 4 while has a slightly flat circular cross-section at the side of the cylinder head. The common flange 5 at the side of the intake air collector 4 extends laterally throughout the four cylinders of the engine. The flange 5 is formed at suitable positions with bolt holes 8 for bolts (not shown) to be engaged with the intake air collector 4 as shown in FIG. 3.

Figure 3:
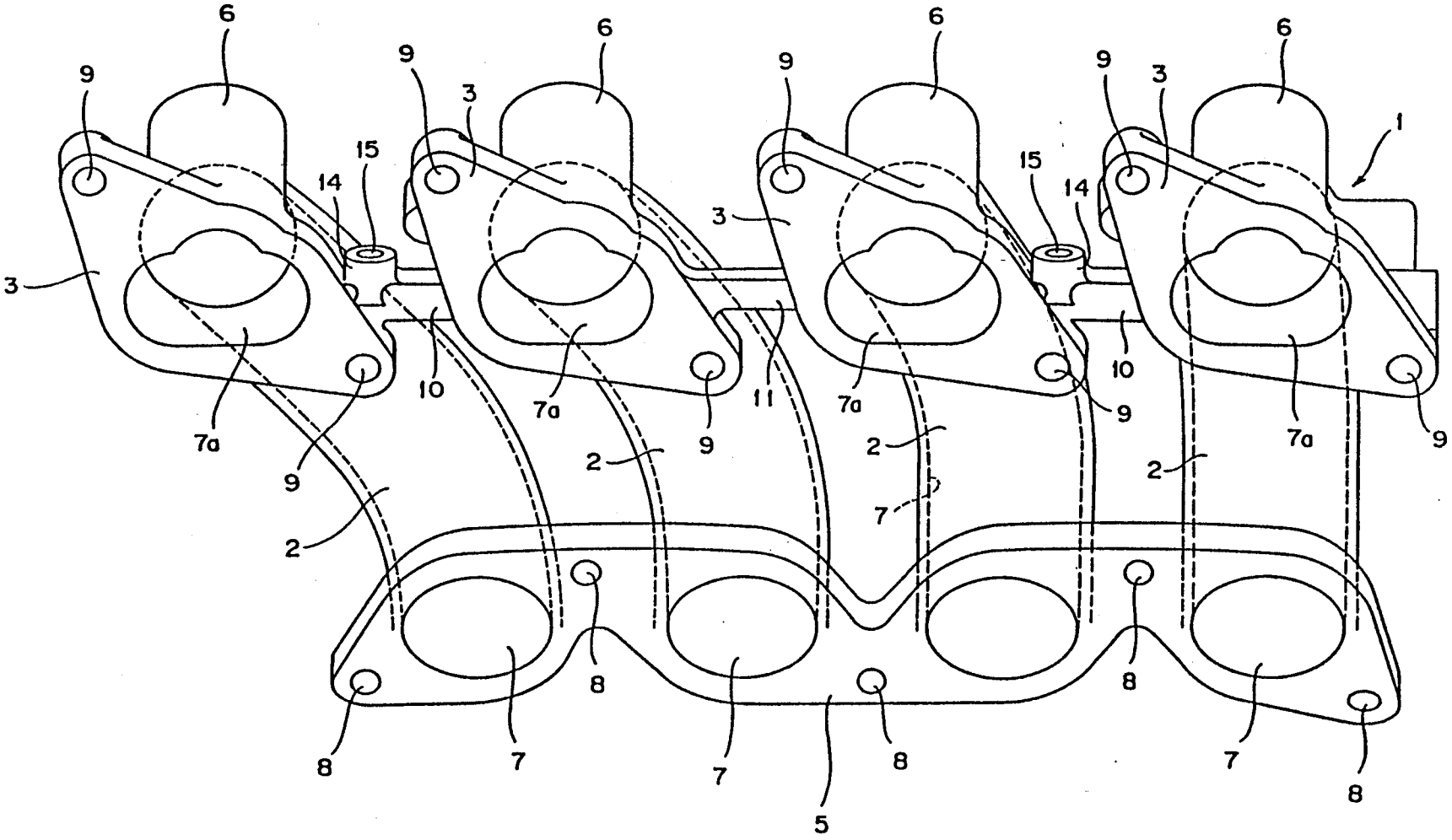
FIG. 3 is a front view of the intake manifold of FIG. 1, as viewed from the direction of an arrow III of FIG. 2.

As shown in FIGS. 1 and 3, the four flange sections 3 at the side of the cylinder head are formed independent and separate from each other so as to be integral with the respective branch runners 2. Each flange section 3 is formed with a pair of bolt holes 9 for bolts (not shown) to be engaged with the cylinder head, so that the flange section 3 for the adjacent two engine cylinders (Nos. 1 and 2 engine cylinders or Nos. 3 and 4 engine cylinders) are fixedly connected with each other by a rod-like rib section 10. It will be understood that the four engine cylinders are aligned in the order of Nos. 1, 2, 3 and 4 engine cylinders in the inline engine to which the intake manifold 1 of this embodiment is installed.

Each rib section 10 extends generally along an imaginary line (not shown) connecting the centers of the intake air openings *7a*, *7a* of the respective flange sections 3, 3. The rib section 10 is integral at its opposite ends with the adjacent flange sections 3, 3. The intake air opening *7a* forms part of the intake air passage 7. It will be understood that the two intermediate flange sections 3, 3 which are interposed between the two outer side flanges 3, 3 are not connected with each other by the rod-like rib section 10 but connected with each other by a slender rib section 11. The rod-like rib section 10 is formed thereinside with a gas passage 12 which is communicated with the intake air passage 7 of each branch runner 2. The gas passage 12 in the rib section 10 between the flange sections 3, 3 for the engine cylinders Nos. 1 and 2 is formed by drilling through the flange sections 3, 3 from the side of the No. 1 engine cylinder or the right side in FIG. 1. On the contrary, the gas passage 12 in the rib section 3 between the flange sections 3, 3 for the Nos. 3 and 4 engine cylinders is formed by drilling through the flanges sections 3, 3 from the side of the No. 4 engine cylinder or the left side in FIG. 1. Thus, the intake air passages 7, 7 of the adjacent branch runners 2, 2 are communicated with each other through the gas passage 12. An unnecessary end part of a drilled hole whose part constitutes the gas passage 12 is tightly closed with a plug 13 which is press-fitted. The opposite ends 12*a*, 12*a* of the gas passage 12 open respectively to the adjacent branch runner intake air passages 7, 7 at the locations near the intake air openings *7a*, *7a* as shown in FIG. 2. Each rib section 10 is integrally formed with a boss 14 in which a gas inlet opening 15 is formed. The gas inlet opening 15 is located generally intermediate of the length of the gas passage 12 and formed by drilling. The gas inlet opening 15 is communicated with the gas passage 12 so that gas such as blow-by gas introduced through the gas inlet opening 15 is uniformly distributed to the adjacent two intake air passages 7, 7. The gas may be EGR (Exhaust Gas Recirculation) gas which is a part of exhaust gas recirculated from the exhaust system to the intake system.

Figure 5:
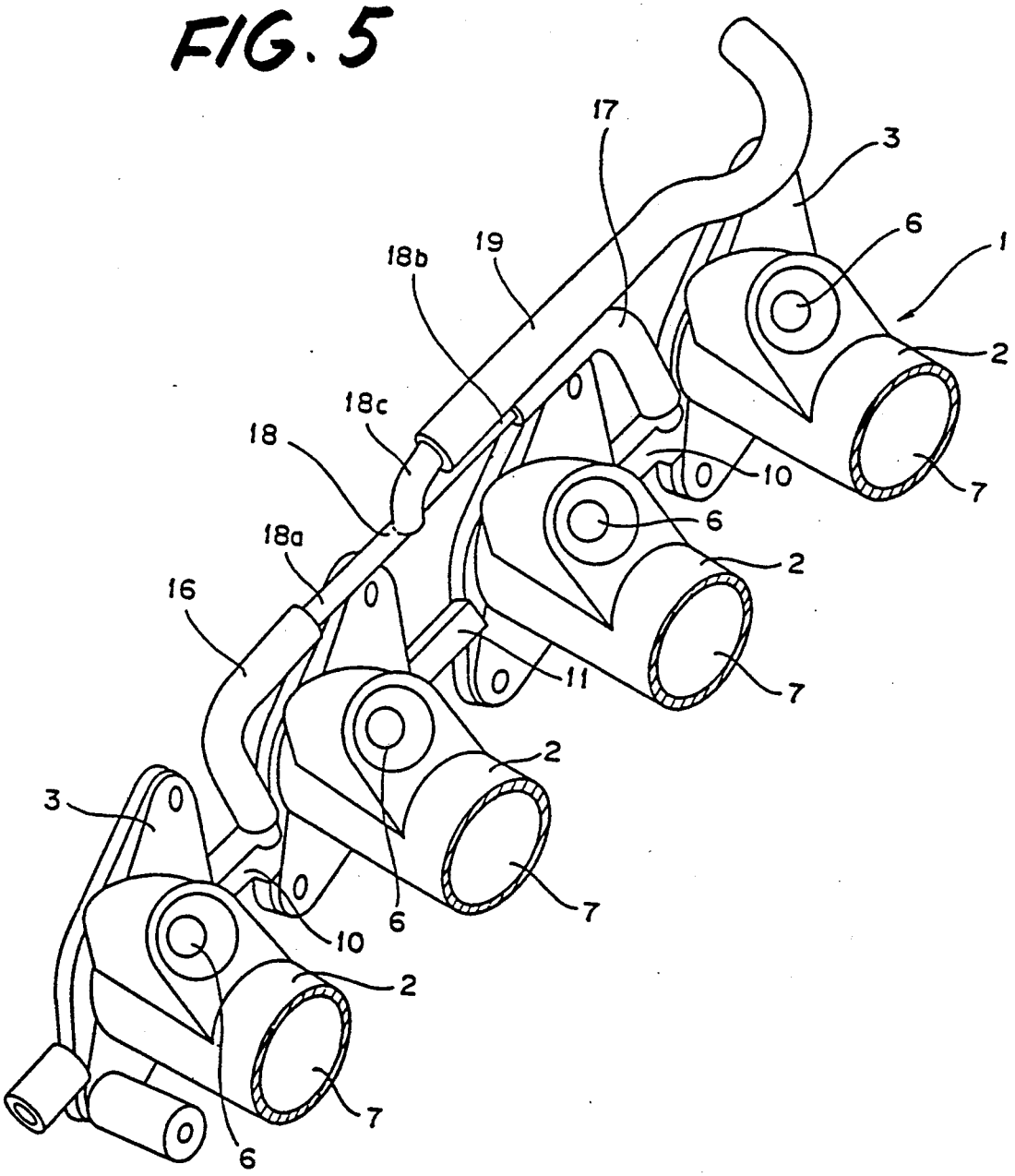
FIG. 5 is a perspective view of an essential part of the intake manifold of FIG. 1, showing a state in which outer pipings are installed.

FIG. 5 shows an outer piping arrangement by which the gas is introduced into the gas passages 12, 12 of the rib sections 10, 10. Rubber hoses 16, 17 are respectively connected at their one end with the bosses 14, 14 through metal connectors (not shown). The other ends of the respective hoses 16, 17 are respectively connected with the horizontal pipe sections 18*a*, 18*b* of a T shaped connector 18. A rubber hose 19 is connected to the vertical pipe section 18*c* of the T-shaped connector 18. It will be understood that the horizontal pipe sections 18*a*, 18*b* are generally equal in length and therefore the vertical pipe section 18*c* is formed at the intermediate portion between the horizontal pipe sections 18*a*, 18*b*. It will be noted that the T-shaped connector 18 is disposed between the both rib sections 10, 10 so that a gas flow path including the pipe section 18*a* and the other gas flow path including the pipe section 18*b* are equal in gas flow distance from the vertical pipe section 18*c* to the gas inlet opening 15.

With the thus arranged intake manifold 1, the gas such as blow-by gas supplied through the rubber pipe 19 is first distributed to the left and right sides through the T-shaped connector 18 and guided to the two gas inlet openings 15, 15. Then, the gas flows through the gas inlet opening 15 and introduced through the gas passage 12 into the intake air passage 7 of each branch runner 2. By virtue of such a gas distribution arrangement, uniform gas distribution characteristics to the respective branch runners 2 can be obtained regardless of flow amounts of the blow-by gas or the like and of flow amounts of intake air in the respeCtiVe intake air passages 7. In this gas distribution arrangement, the gas passages 12 for the final distribution of the gas toward the respective engine cylinders are formed in rib sections 10 integral with the branch runners 2 and therefore the outer pipings of the gas distribution arrangement is considerably simplified. In addition, the gas passages 12 are easily formed by drilling, thereby facilitating production of the gas distribution arrangement.

Introduction of the gas such as blow-by gas is made at the location in the vicinity of the intake port of the cylinder head. Accordingly, the uniformly distributed gas is securely introduced into each engine cylinder. This avoids the backward flow of the gas to the side of a throttle valve (not shown), thereby preventing the throttle valve from contamination while preventing condensed water from being gathered in the intake air collector 4.

While the intake manifold has been shown and described as being used for the inline four cylinder type engine, it will be understood that the principle of the intake manifold of the present invention may be applied to other types of internal combustion engines, for example, V-type engines and engines having different number of engine cylinders.

What is claimed is:

1. An intake manifold for an internal combustion engine, comprising:

a plurality of branch runners each of which is formed therein with an intake air passage, each branch runner having a flange section which is fixedly secured to a cylinder head of the engine;

a rib section for fixedly connecting each pair of flange sections of said branch runners which are located adjacent with each other;

means defining a gas passage in each said rib section, said gas passage communicating with said intake air passages of said adjacent branch runners; and means defining a gas inlet opening in each rib section, said gas inlet opening communicating with the gas passage in said rib section so that is introduced through said gas inlet opening into said gas passage.

2. An intake manifold as claimed in claim 1, wherein said plurality of branch runners include first and second branch runners which are adjacent to each other and respectively for two cylinders of the engine.

3. An intake manifold as claimed in claim 2, wherein said rib section has first and second ends which are opposite to each other, said first end being integral with the flange section of said first branch runner, said second end being integral with the flange section of said second branch runner.

4. An intake manifold as claimed in claim 1, wherein said gas passage having first and second ends which are opposite to each other, said first end being fluidly connected to the intake air passage of said first branch runner, said second end being fluidly connected to the intake air passage of said second branch runner.

5. An intake manifold as claimed in claim 1, wherein said gas inlet opening is located generally intermediate of length of said gas passage.

6. An intake manifold as claimed in claim 1, further comprising means for introducing the gas for emission control into said gas inlet opening.

7. An intake manifold as claimed in claim 6, wherein said gas introducing means includes means for introducing blow by gas into said gas inlet opening.

8. An intake manifold as claimed in claim 6, wherein said gas introducing means includes means for introducing EGR gas into said gas inlet opening.

9. An intake manifold for an internal combustion engine, comprising:

a plurality of branch runners each of which is formed therein with an intake air passage;

a plurality of flange sections integrally connected with branch runners, respectively, said flange sections being fixedly secured to a cylinder head of the engine, said flange sections being separate and independent from each other;

a rod-like rib section for fixedly connecting each pair of said flange sections which are located adjacent with each other;

means defining a gas passage in each said rib section, said gas passage communicating with said intake air passages of said adjacent branch runners; and means defining a gas inlet opening serving each rib section, said gas inlet opening communicating with said gas passage in said rib section so that gas is introduced through said gas inlet opening into said gas passage.

10. An intake manifold as claimed in claim 1, wherein said rib section extends generally along an imaginary line connecting the centers of intake air openings of said respective flange sections.

11. An intake manifold as claimed in claim 1, wherein said engine is of an inline four cylinder type and has first, second, third and fourth engine cylinders which are arranged in the order of number.

12. An intake manifold as claimed in claim 11, wherein said gas passage in said rib section between said flange sections for said engine cylinders first and second is formed straight through said flange sections.

13. An intake manifold as claimed in claim 11, wherein said gas passage in said rib section between said flange sections for said engine cylinders third and fourth is formed straight through said flange sections.

14. An intake manifold as claimed in claim 1, wherein said branch runner is generally U-shaped.

* * * * *